US007931753B2

(12) United States Patent
Bitter et al.

(10) Patent No.: US 7,931,753 B2
(45) Date of Patent: Apr. 26, 2011

(54) METHOD FOR REMOVING DEPOSITS CONTAINING MAGNETITE AND COPPER FROM CONTAINERS IN INDUSTRIAL AND POWER PLANTS

(75) Inventors: Konrad Bitter, Herzogenaurach (DE); Ursula Hollwedel, Schnaittach (DE); Enkhtsetseg Batchuluun, Erlangen (DE)

(73) Assignee: Areva NP GmbH, Erlangen (DE)

( * ) Notice: Subject to any disclaimer, the term of this patent is extended or adjusted under 35 U.S.C. 154(b) by 100 days.

(21) Appl. No.: 12/555,063

(22) Filed: Sep. 8, 2009

(65) Prior Publication Data

US 2010/0012154 A1 Jan. 21, 2010

Related U.S. Application Data

(63) Continuation of application No. PCT/EP2008/001300, filed on Feb. 20, 2008.

(30) Foreign Application Priority Data

Mar. 7, 2007 (DE) ..... 10 2007 011 063
May 18, 2007 (DE) ..... 10 2007 023 247

(51) Int. Cl.
*B08B 3/04* (2006.01)

(52) U.S. Cl. ..... 134/22.18; 134/22.1; 134/22.11; 134/22.13; 134/22.14; 134/22.19; 134/26; 134/27; 134/29; 134/30; 134/35; 134/36; 134/42; 510/108; 510/109; 510/375; 510/435

(58) Field of Classification Search ..... 510/108, 510/109, 375, 435; 134/22.1, 22.11, 22.13, 134/22.14, 22.17, 22.18, 22.19, 26, 27, 29, 134/30, 34, 35, 36, 42
See application file for complete search history.

(56) References Cited

U.S. PATENT DOCUMENTS

| | | | | |
|---|---|---|---|---|
| 3,072,502 | A | 1/1963 | Alfano | |
| 3,248,269 | A | 4/1966 | Bell | |
| 3,627,687 | A | 12/1971 | Teumac et al. | |
| 3,803,042 | A * | 4/1974 | Knox et al. | 510/269 |
| 3,854,996 | A * | 12/1974 | Frost et al. | 134/2 |
| 3,996,062 | A * | 12/1976 | Frost et al. | 134/2 |
| 4,666,528 | A | 5/1987 | Arrington et al. | |
| 5,009,714 | A * | 4/1991 | Arrington et al. | 134/2 |
| 5,037,483 | A * | 8/1991 | Dubin | 134/3 |
| 5,164,015 | A | 11/1992 | Kuhnke et al. | |
| 5,413,168 | A * | 5/1995 | Baum | 165/95 |
| 6,695,927 | B1 * | 2/2004 | Hollwedel et al. | 134/2 |
| 7,857,911 | B2 * | 12/2010 | Varrin et al. | 134/22.19 |
| 2007/0267046 | A1 * | 11/2007 | Bitter et al. | 134/29 |

FOREIGN PATENT DOCUMENTS

| | | | |
|---|---|---|---|
| DE | 19857342 | A1 | 2/2000 |
| EP | 0273182 | A1 | 7/1988 |
| FR | 2691282 | A1 | 11/1993 |
| FR | 2764364 | A1 | 12/1998 |
| GB | 1065016 | A | 4/1967 |
| GB | 1109389 | A | 4/1968 |
| GB | 1132122 | A | 10/1968 |
| UA | 64145 | A | 2/2004 |

OTHER PUBLICATIONS

International Search Report dated Jun. 23, 2008.

* cited by examiner

*Primary Examiner* — Sharidan Carrillo
(74) *Attorney, Agent, or Firm* — Laurence A. Greenberg; Werner H. Sterner; Ralph E. Locher

(57) ABSTRACT

A method to remove deposits containing magnetite and copper from a container, particularly from a steam generator of a nuclear power plant. In a first step, the container is treated using an alkaline cleaning solution containing a complexing agent forming a soluble complex with iron ions, a reducing agent, and an alkalizing agent. In a second step a further complexing agent forming a more stable complex with iron III ions than the complexing agent used in the first step and an oxidant are added to the cleaning solution of the first step present in the container.

18 Claims, No Drawings

METHOD FOR REMOVING DEPOSITS CONTAINING MAGNETITE AND COPPER FROM CONTAINERS IN INDUSTRIAL AND POWER PLANTS

CROSS-REFERENCE TO RELATED APPLICATION

This is a continuation, under 35 U.S.C. §120, of copending international application No. PCT/EP2008/001300, filed Feb. 20, 2008, which designated the United States; this application also claims the priority, under 35 U.S.C. §119, of German patent application Nos. DE 10 2007 011 063.6, filed Mar. 7, 2007 and DE 10 2007 023 247.2, filed May 18, 2007; the prior applications are herewith incorporated by reference in their entirety.

BACKGROUND OF THE INVENTION

Field of the Invention

The invention relates to a method for removing deposits containing magnetite and copper from containers in industrial and power plants, in particular from steam generators of nuclear power plants. The copper originates from components such as pumps, valves, condensers having brass pipes, and the like, and is present in metallic form, in some cases also as copper oxide. The greatest part of the internals of the water-steam circulation of nuclear power plants is formed of C steel or lower-alloy steels. The deposits adhere in some cases as coatings on the component surfaces, and in some cases settle as sludge in containers, such as the steam generators, for example a steam generator. The deposits must be removed from time to time because, for example in the case of steam generators, they hinder the heat transfer to heat-exchanging walls or cause selective corrosion. For removing deposits, the inner surfaces of the container are brought into contact with a cleaning solution, generally at elevated temperature, in order to dissolve the coatings, which contain magnetite ($Fe_3O_4$), copper oxide ($Cu_2O$) and metallic copper. In order to avoid a corrosive attack, which is caused, for example, by a decrease in pH after evaporation of the cleaning solution, which serves for thorough mixing, on the material of the container, which is designated below as base metal, as a rule an alkaline solution (pH>7) is employed. Metallic copper can be dissolved only in the presence of an oxidizing agent. The dissolution of the magnetite is generally effected under reducing conditions in order to avoid oxidative dissolution of the base metal. In such methods, the magnetite is first dissolved under reducing conditions with addition of a complexing agent. After removal of the cleaning solution and optionally after washing of the container, the metallic copper is dissolved with an alkaline cleaning solution in the presence of an oxidizing agent and of a complexing agent. Oxidizing agents used are strong oxidizing agents such as oxygen and hydrogen peroxide, which would convert the dissolved $Fe^{2+}$ immediately into $Fe^{3+}$. For this reason, the container must be emptied before carrying out the copper dissolution, which increases the amount of cleaning solution to be disposed of. If in fact the reaction solution of the magnetite dissolution were not to be removed and an oxidizing agent were added to the solution, this would convert the iron(II) dissolved in complex form into iron(III), which would react with the base metal with dissolution of elemental iron.

A method which is intended to provide a remedy here is disclosed in published, non-prosecuted German patent application DE 198 57 342 A1. The dissolution of magnetite and of copper is carried out with a single cleaning solution, this being modified after carrying out the dissolution of the iron so that it is suitable for dissolving copper. First, the container is treated at a temperature above 160° C. with an alkaline cleaning solution which contains a reducing agent, for example hydrazine, and nitrilotriacetic acid (NTA) as a complexing agent. NTA forms a soluble complex with Fe(II) ions, with the result that dissolution of magnetite is accelerated and the iron(II) is kept in solution in complexed form. By use of the reducing agent, iron(III) present in the magnetite is reduced to iron(II) and the Cu(I) of the abovementioned copper oxide is reduced to metallic copper. For example ammonia or morpholine is used as an alkalizing agent. For the dissolution of the copper, the cleaning solution is cooled to 50° C. to 160° C., its pH is increased and oxygen is blown in or hydrogen peroxide is metered in for establishing oxidizing conditions. The disadvantage of this method is the removal of a relatively large amount of base metal.

U.S. Pat. No. 3,627,687 discloses a method in which magnetite and copper are dissolved with a cleaning solution which from the beginning is such that it simultaneously dissolves magnetite and copper. It is adjusted to a pH of 7 to 10 and contains 1% to 10% of a polyacetic acid, for example ethylenediaminetetraacetic acid (EDTA), as a complexing agent and 0.1 to 5% of a polyethyleneimine. This method, too, is associated with removal of a relatively large amount of base metal, in spite of the use of corrosion inhibitors. Moreover, most inhibitors are effective at temperatures above 120° C. or decompose. Inhibitors which can be used at the temperatures contain sulfur.

SUMMARY OF THE INVENTION

It is accordingly an object of the invention to provide a method for removing deposits containing magnetite and copper from containers in industrial and power plants which overcomes the above-mentioned disadvantages of the prior art methods of this general type, which manages with removal of a small amount of base metal without discharge of the cleaning solution between the dissolution of magnetite and the dissolution of copper.

The object is achieved by a method in which, in a first step, the container is treated with an alkaline cleaning solution which contains a complexing agent forming a soluble complex with iron(II) ions, a reducing agent and an alkalizing agent and, in a second step, a further complexing agent which forms a more stable complex with iron(III) ions than the complexing agent used in the first step, and an oxidizing agent are metered into the cleaning solution of the first step which is present in the container.

In the method according to the invention, the dissolution of the magnetite is carried out in virtually the same manner as in the method of published, non-prosecuted German patent application DE 198 57 342. Attack by the cleaning solution on the base metal and corresponding removal of material are at a relatively low level in a procedure of this type, especially if temperatures of 140° C. to 180° C. are employed, as in a preferred variant of the method. At such temperatures, the reaction between the complexing agent and the iron(II) originating from the magnetite takes place substantially faster than the attack on the base metal, which likewise takes place via iron(II). In the second step of the method, the fact that the cleaning agent still contains the iron(II) complex of the first step of the method is problematic. If in fact the oxidizing agent required for dissolving metallic copper is metered in, it is scarcely possible to avoid oxidation of the complexed iron (II) and formation of an iron(III) complex. Iron(III) complexes of the complexing agents such as EDTA and NTA, used in methods of the present type are less stable in alkaline solution than the corresponding iron(II) complexes, i.e. they may be destroyed under the conditions prevailing in the second step of the method, the iron(III) ions liberated forming, with hydroxide ions present in the solution, a sparingly soluble precipitate of iron hydroxide, which would have to be removed from the container by complicated washing. Moreover, a reaction between the elemental iron of the base metal and iron(III) ions would occur on surfaces freed from magnetite coatings or deposits, with iron(II) forming: $Fe+2Fe^{3+}$--->$3\ Fe^{2+}$. Owing to the oxidizing agent present, the divalent iron is oxidized to trivalent iron, which in turn reacts with the iron of the base metal. In addition to the dissolution of copper, there is therefore corrosion of the base metal. According to the invention, this undesired reaction is at least suppressed by metering in a complexing agent which, under the conditions prevailing in the second step, forms a complex with iron(III) ions which is more stable than the corresponding complex with the complexing agent of the first step of the method. In this way, the concentration of free iron(III) ions is reduced, for example by immediately trapping freshly formed iron(III) ions. Removal of base metal in the second step of the method is prevented or at least reduced thereby.

In a preferred variant of the method, first the further complexing agent and then the oxidizing agent are added. Any free, i.e. uncomplexed iron(II) ions present in the cleaning solution are bound thereby by the further complexing agent so that, on addition of the oxidizing agent, free iron(II) ions from which iron(III) ions may form are no longer present. This effect is particularly effective when thorough mixing of the cleaning solution is effected preferably by blowing in a non-oxidizing or only weakly oxidizing gas such as, or air or preferably an inert gas such as nitrogen or argon, before the addition of the oxidizing agent.

The oxidizing agent added in the second step of the method has two functions. It serves firstly for oxidizing metallic copper to Cu(II), which is complexed by the further complexing agent and optionally by excess complexing agent of the first step of the method. By metering in a superstoichiometric amount of oxidizing agent in comparison with the amount of copper to be dissolved, unconsumed reducing agent is neutralized in the first step of the method.

In conventional methods, hydrogen peroxide or oxygen is used for oxidizing the copper. These are very strong oxidizing agents with a correspondingly strong oxidizing effect with respect to free or complexed iron(II) and with respect to the abovementioned iron complexes. The use of such an oxidizing agent is therefore always accompanied by an increase in the concentration of free iron(III) ions and a corresponding removal of the base metal. According to the invention, this negative effect is at least moderated by using an oxidizing agent whose redox potential in alkaline solution is lower than that of hydrogen peroxide or oxygen. As experiments explained further below have shown, hydroxylamine is particularly suitable. It is true that its oxidizing power is sufficient for oxidizing metallic copper and, in the first step of the method, unconsumed hydrazine. Its oxidative effect with respect to complexed or free iron(II) is, however, weaker than in the case of the classical oxidizing agents oxygen and hydrogen peroxide, so that removal of base metal takes place only to a reduced extent.

The addition of polyethyleneimine is effected primarily for the purpose of preventing the formation of free Fe(III) ions. Accordingly, in a preferred variant of the method, a substoichiometric amount relative to the amount of copper to be dissolved is metered in. In this way, if need be, a part of the copper ions is complexed by the polyethyleneimine. To bind the remaining amount of copper or generally for complexing the copper, a further complexing agent, for example a complexing agent already used in the first step of the method, such as EDTA or NTA, is used the cleaning solution. In the case of the polyethyleneimine used, a carboxyl group, for example $CH_3COO^-$, is bonded at least to some of the N atoms of the main chain.

In a preferred variant of the method, the dissolution of copper is accelerated by adding ammonium in the form of at least one ammonium salt, preferably ammonium carbonate, to the cleaning solution. Ammonium ions catalyze the dissolution of copper in a manner known per se in the presence of an oxidizing agent. In contrast to ammonium salts containing chloride or sulfate, ammonium carbonate causes no corrosion. A further acceleration of the copper dissolution is effected with the aid of ammonium nitrate.

The first step of the method is preferably carried out at a temperature of 140° C. to 180° C. The addition of a corrosion inhibitor is not required since there is practically no danger of corrosive attack by the complexing agent on the base metal. At such high temperatures, the complexing reaction between the complexing agent and iron(II) and/or iron(III) ions originating from the magnetite does in fact take place substantially faster than the dissolution of the base metal by the complexing agent. However, the first step of the method need not necessarily be carried out in a high temperature range. A temperature below 100° C., for example in the range from 80° C. to 95° C., is also conceivable. However, the addition of corrosion inhibitor is expedient since the complexing of the iron(II) and/or iron(III) ions originating from the magnetite is slowed down and accordingly more complexing agent is available for the dissolution of the base metal.

The procedure of the second step of the method is generally carried out at a temperature below 100° C., preferably in the range from 80° C. to 95° C. At low temperatures, the danger that hydroxylamine will be decomposed to $NO_2$ is substantially less than at higher temperatures. $NO_2$ would decompose the complexing agents used.

Other features which are considered as characteristic for the invention are set forth in the appended claims.

Although the invention is described herein as embodied in a method for removing deposits containing magnetite and copper from containers in industrial and power plants, it is nevertheless not intended to be limited to the details described, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the following experiments.

DETAILED DESCRIPTION OF THE INVENTION

The efficiency of the proposed method was tested in a multiplicity of experiments. Three of these experiments are explained in more detail as described below.

In the case of a temperature above 100° C. in the method, the experiments (No. 507 and No. 512) were carried out in an autoclave made of stainless steel (TA2), otherwise in an open container, for example a beaker (experiment No. 508). For simulating deposits containing magnetite and copper, original deposits respectively sludge from a steam generator of a nuclear power plant are introduced in an amount of 15 g into the respective containers, 85% of magnetite, 10% of Cu and 5% of $Cu_2O$ being present therein. At this point, it should be noted that stated percentages are generally based on percent by weight. To test the removal of material from C steel (carbon steel) surfaces, samples of this material on Teflon-coated stainless steel rods were suspended in the containers and autoclaves.

Experiment No. 507:

This experiment relates to a variant of the method in which the magnetite dissolution is carried out at a temperature of more than 100° C., specifically at 160° C., and the copper dissolution in the pressureless range, i.e. at a temperature below 100° C., namely at about 90° C. After the autoclave has been heated up to 160° C., 445 ml of deionized water are introduced and flushed with argon in order to remove air or to remove oxygen dissolved in the deionized water. Thereafter, 200 ml of an aqueous reaction solution which contains 65.6 g of $(NH_4)_3$-EDTA are added, accordingly to an excess of 5% relative to the stoichiometric amount, i.e. the amount of EDTA required for complexing the amount of iron present in the magnetite. The reaction solution also contains 22 ml of a 25% strength hydrazine hydrate solution. The amount of hydrazine metered in corresponds to four times the stoichiometric amount. The excess ensures that, in spite of a loss of hydrazine due to thermal or catalytic decomposition (owing to the presence of metallic copper), a sufficient amount is always available for the reduction of the iron(III) present in the magnetite. During the magnetite dissolution, a pH of about 9 is established in the cleaning solution.

After about two hours, the second step of the method is initiated by cooling the solution to 80° C. and metering in a complexing agent which bonds Fe(III) ions more strongly compared with the complexing agent (EDTA) used in the first step 1 of the method, namely a polyethyleneimine obtainable under the trade name Trilon®P from BASF, in the form of the original aqueous BASF solution diluted 1:3.4. Trilon®P has a molecular weight of about 50,000 and a nitrogen/carbon atom ratio in the main chain of 0.5. This complexing agent binds in particular any free iron(III) ions present, which is the case, for example, if the amount of magnetite sludge present in a container was underestimated and an insufficient amount of EDTA was therefore metered in. In order to achieve as complete bonding as possible of the free iron(III) ions by Trilon®P or a complexing agent having a comparably strong affinity to iron ions, the cleaning solution is thoroughly mixed by blowing in an inert gas. 200 ml of an aqueous solution which contains 36 ml of a 50% strength hydroxylamine solution are now fed in. The amount of hydroxylamine present therein is twice the stoichiometric amount relative to the metallic copper present and remaining hydrazine. The excess of oxidizing agent ensures that all residual hydrazine is neutralized and sufficient oxidizing agent is available to oxidize all copper to Cu(II). Thereafter, EDTA is fed into the autoclave in a superstoichiometric amount relative to the amount of copper present (dissolved Cu(II)), for example with an excess of 7.2%, in order to bond the Cu(II) formed. For monitoring the progress of the copper dissolution, small samples of the cleaning solution are continuously taken and its copper content is determined, for example by titration. At the end of the second step of the method, after about six hours, in the present case 85% of the metallic copper originally present have gone into solution (see table below) and can be removed—in the application, for example in the cleaning of a steam generator—by discharging the cleaning solution from the container. Under the conditions of the experiment described, the result is removal of only 7 μm of the C steel samples (or of the base metal in the application) respectively a weight loss of 0.0029 g/cm$^2$ (see table below). 96% of the magnetite present is dissolved.

Experiment No. 508:

In a procedure corresponding to experiment 508, the first step of the method is carried out at a temperature below 100° C., specifically at 92° C. A container to be cleaned can be open to the atmosphere. Accordingly, no autoclave is required for the experiment. 1000 ml of deionized water are introduced into an open container (a beaker) and, after heating to 92° C., 400 ml of an aqueous solution which contains 68 g of $(NH_4)_2$-EDTA, 3.8 g of hydrazine hydrate, 10 ml of Korantin®PM and 2 ml of Plurafac are added. Korantin®PM is a of corrosion inhibitor, and Plurafac is a surfactant. Both substances are available from BASF. A surfactant improves the adhesion of the inhibitor to the bare surfaces of the base metal.

The amount of EDTA used corresponds to 111% of the stoichiometric amount required for complexing the amount of iron present (10.4 g). The reducing agent (hydrazine) is added in excess as in the high-temperature method according to experiment 507 (about four times the stoichiometric amount). During the magnet dissolution, a pH of about 9 is maintained.

By sampling and carrying out analyses, the progress of the magnetite dissolution is monitored. If it is found that the magnetite dissolution is approaching its end, in the present case after about 20 hours, step 2 of the method is initiated by metering in 50 ml of an aqueous solution of Trilon®P diluted 1:3.4, with the result that the cleaning solution cools to about 85° C. After thorough mixing by blowing in an inert gas, 100 ml of a reaction solution which contains 26 ml of a 50% strength aqueous hydroxylamine solution are metered in, which corresponds to about 20 g of hydroxylamine. This amount is four times the stoichiometric amount relative to the metallic copper present and remaining hydrazine. After thorough mixing with inert gas, finally 100 ml of a reaction solution are added, which added 15.5 g of $(NH_4)_2$-EDTA and, for accelerating the copper dissolution and as a buffer, 20 g of ammonium carbamate and 20 g of ammonium nitrate. The copper dissolution is complete after about six hours. Dissolution of 96% of the magnetite and dissolution of 85% of the copper, with removal of 18 μm of the C steel samples accordingly to a weight loss of 0.0113 g/cm$^2$, are achieved.

Experiment No. 512:

Experiment 512 substantially simulates the method according to U.S. Pat. No. 3,627,687, in which the magnetite and the copper dissolution is carried out with one and the same alkaline cleaning solution. The cleaning solution according to U.S. Pat. No. 3,627,687 contains substantially EDTA and, as a further complexing agent, a polyethyleneimine which is used in the present experiment in the form of Trilon®P. The copper-containing magnetite sludge also used in the other experiments and 550 ml of deionized water are introduced into an autoclave of the type used in experiment No. 507. After flushing with inert gas, heating to 160° C. is effected and 240 ml of an aqueous reagent solution are metered in. This contains 61 g of $(NH_4)_3$-EDTA and 12 ml of Trilon®P (original solution from BASF). At the beginning of the experiment, the cleaning solution has a pH of about 9. After about 6.5 hours, the experiment is complete. 87% of magnetite have been dissolved and only 5.14% of copper have been dissolved, with removal of 27 μm of the C steel samples accordingly to a weight loss of 0.0213 g/cm$^2$.

| | Experiment 507 | Experiment 508 | Experiment 512 | Experiment |
|---|---|---|---|---|
| Amount of sludge | 12.75 g $Fe_3O_4$ 1.5 g Cu 0.75 g $Cu_2O$ | 14.45 g $Fe_3O_4$ 1.7 g Cu 0.85 g $Cu_2O$ | 12.75 g $Fe_3O_4$ 1.5 g Cu 0.75 g $Cu_2O$ | |
| Temperature | 160° C.[2)] 80° C.[3)] | 80° C. | 160° C. | |
| Duration of experiment | 6.25 h | 28 h | 6.25 h | |
| Cu dissolution | 85% | 50% | 5.14% | |
| Magnetite dissolution | 96% | 95% | 87% | |
| Surface C-steel sample | 179.3 $cm^2/l$ (143.4 $cm^2$ absolute) | 83.98 $cm^2/l$ (146 $cm^2$ absolute) | 91.35 $cm^2/l$ (73.08 $cm^2$ absolute) | |
| Weight loss | 0.0029 $g/cm^2$ | 0.0113 $g/cm^2$ | 0.0213 $g/cm^2$ | |
| Removal of material | 7 μm | 18 μm | 27 μm | |

[1)]cold
[2)]during the iron removal
[3)]during the copper removal

The invention claimed is:

1. A method for removing a deposit containing magnetite and copper from a container, which comprises the steps of:

in a first step, treating a deposit containing magnetite and copper in the container with an alkaline cleaning solution containing a reducing agent, an alkalizing agent, and a complexing agent forming a soluble complex with iron(II) ions originating from the magnetite, wherein the first step dissolves the magnetite in the alkaline cleaning solution;

in a second step, metering a further complexing agent which forms a more stable complex with iron(III) ions than the complexing agent used in the first step, and an oxidizing agent, into the alkaline cleaning solution of the first step which is present in the container, wherein the further complexing agent has a different chemical composition than the complexing agent used in the first step, the second step dissolves the copper in the alkaline cleaning solution; and removing the magnetite and the copper from the container by discharging the alkaline cleaning solution from the container.

2. The method according to claim 1, which comprises adding first the further complexing agent and then the oxidizing agent.

3. The method according to claim 1, which further comprises adding a superstoichiometric amount of the oxidizing agent in comparison with an amount of copper present in the container.

4. The method according to claim 1, which further comprises using an oxidizing agent whose redox potential is lower than that of hydrogen peroxide.

5. The method according to claim 1, which further comprises adding a modified polyethyleneimine as the further complexing agent in the second step of the method.

6. The method according to claim 1, which further comprises adding at least one ammonium salt to the alkaline cleaning solution present in the container.

7. The method according to claim 1, which further comprises carrying out the first step of the method at a temperature of 140° C. to 180° C.

8. The method according to claim 1, which further comprises carrying out the second step of the method at a temperature of less than 100° C.

9. The method according to claim 1, wherein the container is a steam generator of a nuclear power plant.

10. The method according to claim 2, wherein after an addition of the further complexing agent and before the addition of the oxidizing agent, performing a thorough mixing of the alkaline cleaning solution by blowing in a gas.

11. The method according to claim 4, which further comprises using hydroxylamine as the oxidizing agent.

12. The method according to claim 5, which further comprises providing a sodium-free modified polyethyleneimine as the modified polyethyleneimine.

13. The method according to claim 5, which further comprises providing a polyethyleneimine having carboxyl groups as the modified polyethyleneimine.

14. The method according to claim 6, which further comprises metering in ammonium carbonate.

15. The method according to claim 6, which further comprises metering in ammonium nitrate.

16. The method according to claim 8, which further comprises setting a temperature to 80° C. to 95° C.

17. The method according to claim 10, which further comprises blowing in at least one of air, nitrogen and argon as the gas.

18. The method according to claim 12, which further comprises metering in the modified polyethyleneimine, in a substoichiometric amount relative to an amount of copper to be dissolved.

* * * * *